United States Patent [19]

Shore et al.

[11] Patent Number: 4,789,054

[45] Date of Patent: Dec. 6, 1988

[54] VENDING MACHINE FOR RETURNABLE CARTRIDGES

[75] Inventors: Barry Shore, Northbrook; Michael Schwarzberger, Chicago, both of Ill.

[73] Assignee: ABM Industries, Inc., Skokie, Ill.

[21] Appl. No.: 3,067

[22] Filed: Jan. 14, 1987

Related U.S. Application Data

[63] Continuation-in-part of Ser. No. 688,308, Jan. 2, 1985, abandoned.

[51] Int. Cl.[4] ..... G07F 7/00; G07F 11/16

[52] U.S. Cl. ..... 194/212; 221/88; 235/381; 414/282

[58] Field of Search ..... 194/205, 210, 213, 212; 221/2, 5, 78, 79, 81, 87, 88, 195, 220; 364/479; 235/381, 383; 414/277, 281, 282

[56] References Cited

U.S. PATENT DOCUMENTS

| | | | |
|---|---|---|---|
| 3,344,953 | 10/1967 | Krakauer et al. | 221/155 X |
| 3,905,164 | 9/1975 | Mandelbaum | 414/281 X |
| 4,348,152 | 9/1982 | Takamatsu | 414/282 X |
| 4,414,467 | 11/1983 | Gould et al. | 235/381 |
| 4,458,802 | 7/1984 | Maciver et al. | 221/81 X |
| 4,519,522 | 5/1985 | McElwee | 221/13 |
| 4,563,120 | 1/1986 | Josserand | 414/280 X |

FOREIGN PATENT DOCUMENTS 54-66806 5/1979 Japan .

*Primary Examiner*—F. J. Bartuska
*Attorney, Agent, or Firm*—Paul H. Gallagher

[57] ABSTRACT

Vending machine for vending re-usable articles, in response to patron's entering an identification code number, and depositing money. The articles are individually identified (films and video tapes) and of a value greater than the amount required for vending, and upon return by the patron, they are placed, by the machine, in preassigned cubicles. Sensing elements on the articles and in the machines assure that only authorized articles are put therein, and that the article is placed in properly oriented position. Credit is given the patron in response to his depositing money whether an article is delivered or not.

4 Claims, 6 Drawing Sheets

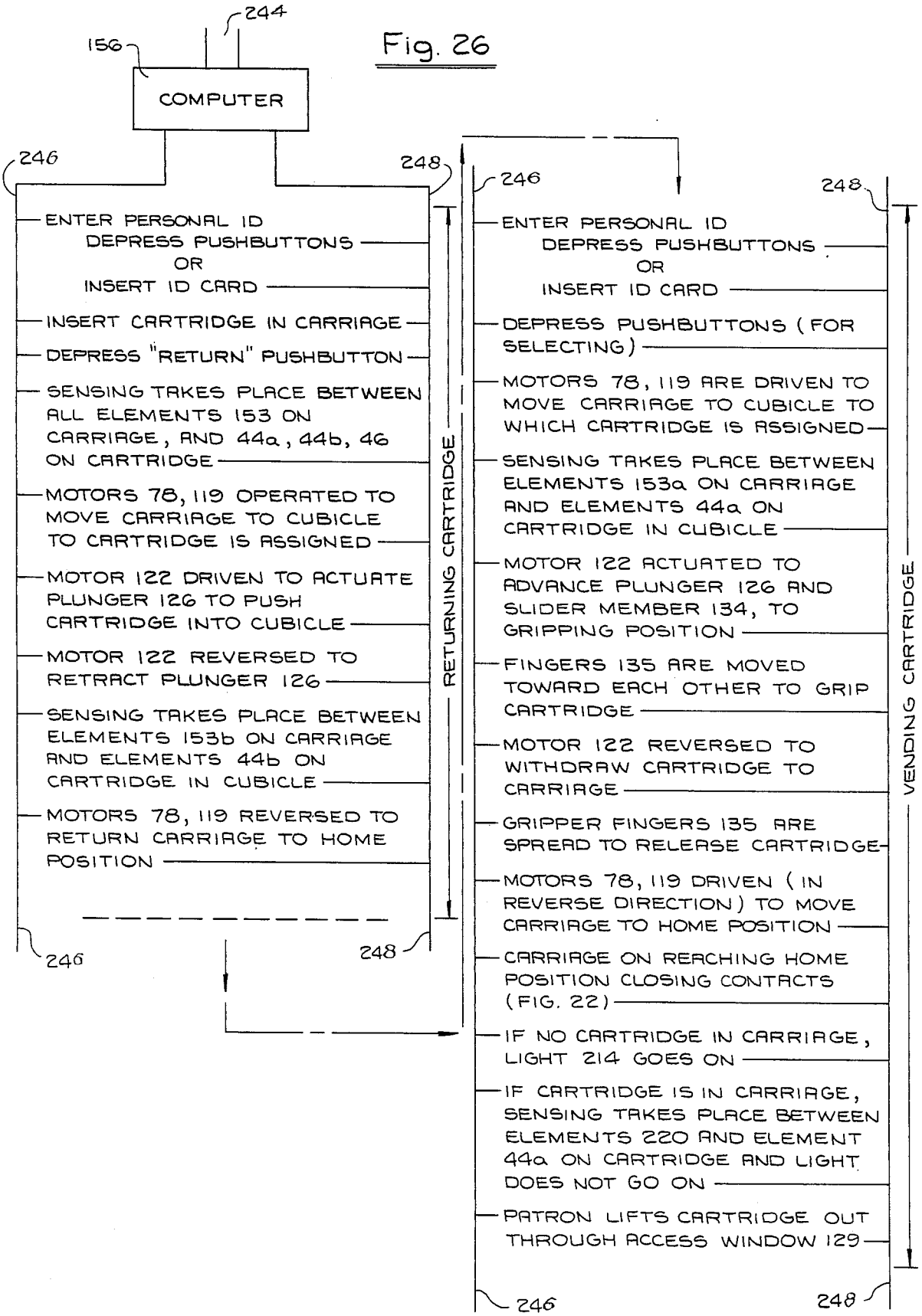
244
156
COMPUTER
Fig. 26
246
248
ENTER PERSONAL ID
DEPRESS PUSHBUTTONS
OR
INSERT ID CARD
INSERT CARTRIDGE IN CARRIAGE
DEPRESS "RETURN" PUSHBUTTON
SENSING TAKES PLACE BETWEEN ALL ELEMENTS 153 ON CARRIAGE, AND 44a, 44b, 46 ON CARTRIDGE
MOTORS 78, 119 OPERATED TO MOVE CARRIAGE TO CUBICLE TO CARTRIDGE IS ASSIGNED
MOTOR 122 DRIVEN TO ACTUATE PLUNGER 126 TO PUSH CARTRIDGE INTO CUBICLE
MOTOR 122 REVERSED TO RETRACT PLUNGER 126
SENSING TAKES PLACE BETWEEN ELEMENTS 153b ON CARRIAGE AND ELEMENTS 44b ON CARTRIDGE IN CUBICLE
MOTORS 78, 119 REVERSED TO RETURN CARRIAGE TO HOME POSITION
RETURNING CARTRIDGE
246
248
246
248
ENTER PERSONAL ID
DEPRESS PUSHBUTTONS
OR
INSERT ID CARD
DEPRESS PUSHBUTTONS (FOR SELECTING)
MOTORS 78, 119 ARE DRIVEN TO MOVE CARRIAGE TO CUBICLE TO WHICH CARTRIDGE IS ASSIGNED
SENSING TAKES PLACE BETWEEN ELEMENTS 153a ON CARRIAGE AND ELEMENTS 44a ON CARTRIDGE IN CUBICLE
MOTOR 122 ACTUATED TO ADVANCE PLUNGER 126 AND SLIDER MEMBER 134, TO GRIPPING POSITION
FINGERS 135 ARE MOVED TOWARD EACH OTHER TO GRIP CARTRIDGE
MOTOR 122 REVERSED TO WITHDRAW CARTRIDGE TO CARRIAGE
GRIPPER FINGERS 135 ARE SPREAD TO RELEASE CARTRIDGE
MOTORS 78, 119 DRIVEN (IN REVERSE DIRECTION) TO MOVE CARRIAGE TO HOME POSITION
CARRIAGE ON REACHING HOME POSITION CLOSING CONTACTS (FIG. 22)
IF NO CARTRIDGE IN CARRIAGE, LIGHT 214 GOES ON
IF CARTRIDGE IS IN CARRIAGE, SENSING TAKES PLACE BETWEEN ELEMENTS 220 AND ELEMENT 44a ON CARTRIDGE AND LIGHT DOES NOT GO ON
PATRON LIFTS CARTRIDGE OUT THROUGH ACCESS WINDOW 129
VENDING CARTRIDGE
246
248

VENDING MACHINE FOR RETURNABLE CARTRIDGES

This application is a continuation-in-part of our prior application Ser. No. 688,308, filed Jan. 2, 1985, now abandoned.

FIELD OF THE INVENTION

The invention resides in the field of vending, particularly vending non-perishable and reusable articles, which includes the feature of returning the articles to the vending machine by a patron after having previously received them in a vending operation.

CROSS REFERENCE

U.S. Pat. No. 4,598,810, issued Jul. 8, 1986.

OBJECTS OF THE INVENTION

A broad object of the invention is to provide a novel vending machine, and method related thereto, of the character wherein the articles treated are of re-usable kind, they are vended in response to a patron entering his identification and depositing money, tangible or credit, and making a selection, and they are later received by the machine, in return thereto, by the patron, and particularly such having the following features and advantages:

1. Assurance is had that the selected article is actually vended and delivered physically.
2. Determination is made whether an article, when returned, is placed in proper position by the patron so as to enable proper vending in a later operation.
3. Determination is made in the step of returning an article, whether it is an authorized article, i.e., as having been previously vended by the machine in question
4. Determination is made, in the step of returning an article, of the proper location for the article, such as an individual cubicle, and the article is returned to that location, and indication is made of such return
5. Payment is accepted and credit given according to whether an article is delivered or not, and in a return operation, whether it is returned or not.
6. The articles in the vending machine, to be vended, are all displayed to the patron and easily observed by him.
7. The physical construction of the vending machine embodying the invention is especially effective for utilization of computer control and operation.
8. The vending machine includes a computer, and is arranged so that in response to the patron initially entering control signals into the machine at the beginning of a vending or returning operation, the operation is completed under the control of the computer and without the requirement for any further control signals to be entered by the patron.

DESCRIPTION OF A PREFERRED EMBODIMENT

In the drawings:

FIG. 26 is a diagram of the computer used in the vending machine and the principal steps in the vending operations.

The apparatus and specific components illustrated in the accompanying drawings constitute particular examples of a wide variety of apparatuses or devices capable of carrying out the basic functions of the invention. They relate to the mechanical components and their operating steps, and the steps of controlling their operation. For example, motors are driven, and mechanical operating steps performed, under control of electrical circuitry, itself controlled by a computer, and the vending machine is an embodiment of physical construction that enables and utilizes a full program of operation by the computer.

The specific details of those steps are performed and the steps controlled in a known manner and the description thereof need not be set out in great detail. This is true also of the computer, which is a known item, its functioning being well known, and the details thereof being readily accessible to all. Reference to these two phases is made again hereinbelow; also various components and operating steps are disclosed and described in our U.S. Pat. No. 4,598,810 identified above, to which reference may be had for additional details.

An important feature is that in a vending or returning operation, the patron need not observe the progress of the operation, and make any control or corrective steps during the operation, but merely relies on the effects of signals initially entered.

Referring in detail to the drawings, the mechanical Part of the vending machine is shown principally in FIGS. 1–5. These figures show the main operating components, but as much detail as possible has been omitted, for convenience.

Figure 1:
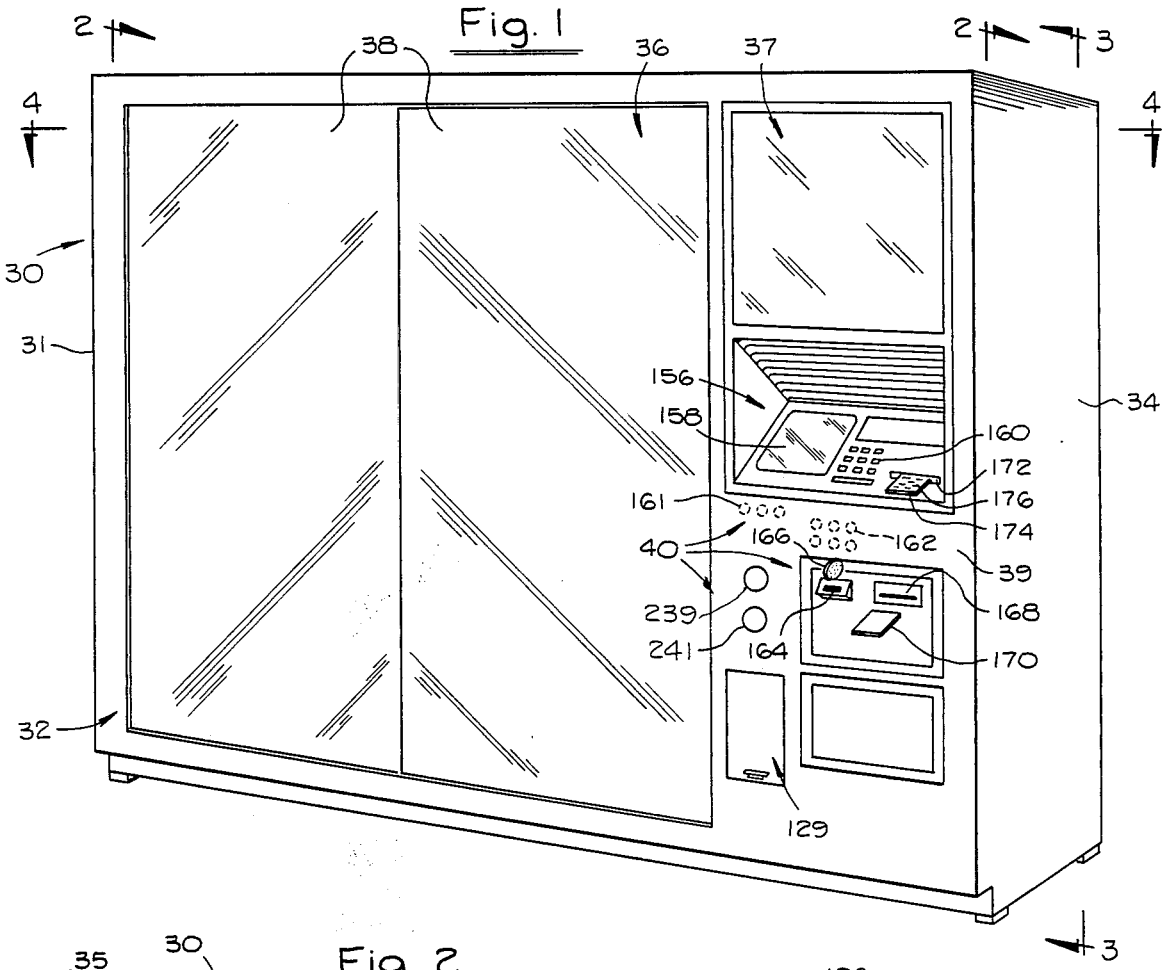
FIG. 1 is a perspective view of a vending machine embodying the features of the present invention.

The vending machine is indicated in its entirety at 30 and includes an outer cabinet or housing 31 having a front side 32, a rear side 33, a right side 34 and a left side 35, this orientation being relative to a patron facing it as viewed in FIG. 1. This orientation is utilized in referring to the positions and operation of the various parts and components of the apparatus. The cabinet has a compartment 36 covered by a transparent panel 38 and a compartment 37 covered by a panel 39, on the latter of which instrumentalities and controls and indicators are mounted, identified in their entirety at 40. These controls and indicators will be individually identified and their functions described hereinbelow.

Figure 6:
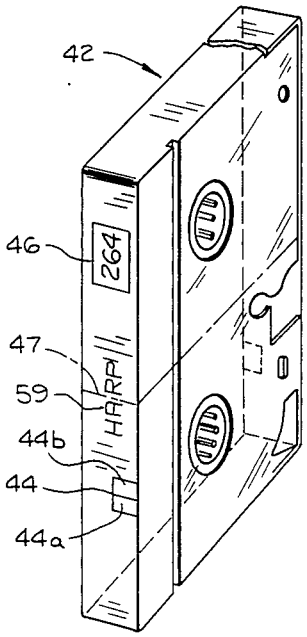
FIG. 6 is a perspective view of a cartridge containing a film or videotape, constituting an article to be vended.

The vending machine is adapted to vend any of a wide variety of articles or items, but the present adaptation is vending films or videotapes as shown in FIG. 6 and indicated at 42. The item 42 includes a cartridge enclosing the film or tape. As used herein, the term cartridge is to be interpreted generically to cover any articles vended. The items are individually identified, and may be so identified in any of various ways, one of which is disclosed herein, and others of which are referred to hereinbelow. In the present disclosure, the cartridge has identifying elements 44, 46, the element 44 being divided into two areas **44*a*, 44*b*, referred to again hereinbelow. The cartridge 42 may be otherwise identical with presently known cartridges. A median line 47 is shown as a reference location, for indicating the location of the identifying elements 44, 46**, in assuring the proper placement of the cartridge in the apparatus, to be referred to again.

Disposed in the compartment 36 is a magazine or depository 48, for holding the cartridges, having a front side 49 and a rear side 50. The magazine is simple in structure, and is totally without moving parts, being a static and passive part of the apparatus. The magazine includes a plurality of shelves 51 in the form of simple flat plates, mounted on and held in vertically spaced position by a plurality of vertical rods 52 to which the plates are suitably secured as by welding. The rods are so spaced horizontally transversely as to form cubicles, or cells, or slots 54. The rods are spaced apart in that direction according to the desired size and number of cubicles, and the rods may be three in number in depth direction, from front to rear. The cubicles are open at both front and rear and at the front ends lie essentially in a plane.

The cubicles may be of any suitable number, such as for example forty or fifty across on each shelf, and there are a suitable number of shelves, or horizontal rows, such as eight as illustrated.

In the magazine, the cubicles are distributed throughout a large area constituting essentially the size of the magazine, and this area is covered by and all visually exposed through the transparent panel 38. The cartridges when in the cubicles are of course exposed through the open front ends of the cubicles, and exposed to view through the transparent panel 38, to the patron. There are no cubicles or cartridges hidden from the patron and hence the patron can observe the full selection of cartridges held in the machine.

The cartridges are provided with readable titles of the contents of the recordings therein, as at 59, which are of course observable by the patron, providing an attraction to the patron, and a convenience to him in identifying the cartridges. As a further feature, the cubicles are only one-deep, i.e., from front to rear of the magazine, assuring exposure of the full selection.

Figure 10:
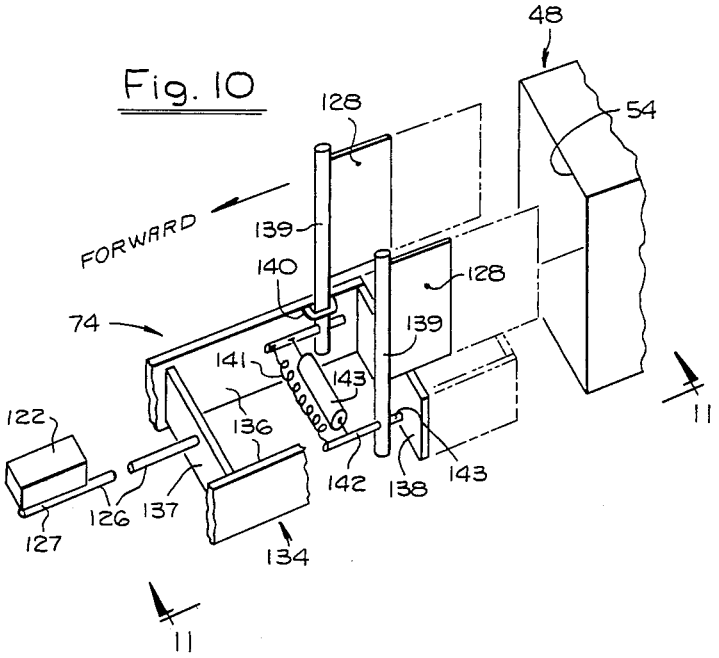
FIG. 10 is a fragmentary perspective view of certain operating parts of a unit forming a main component of the carriage which carries the articles being vended.
Figure 11:
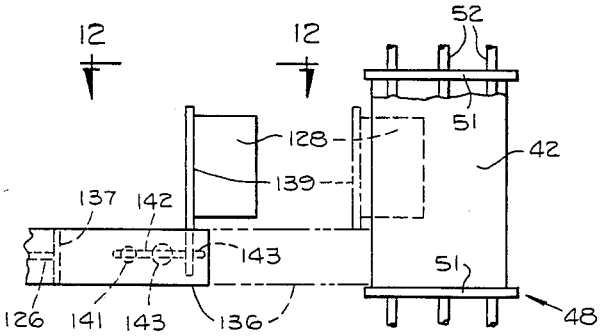
FIG. 11 is a side view of the unit shown in FIG. 10, taken at line 11—11 of FIG. 10.
Figure 12:
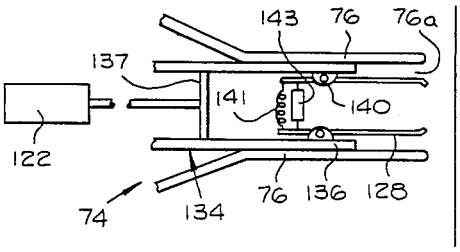
FIG. 12 is a top view of the component of FIGS. 10 and 11, taken at line 12—12 of FIG. 11.
Figure 14:
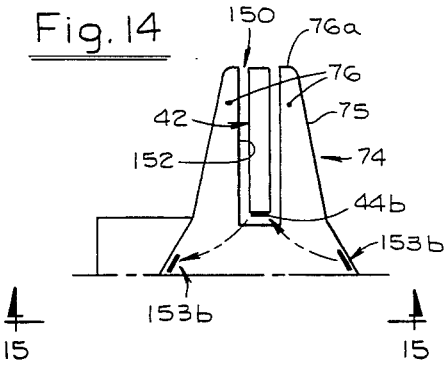
FIG. 14 is a fragmentary view oriented according to FIG. 8, showing a portion of the latter figure, and including sensing means for sensing an article in the carriage.

The present disclosure includes exemplary means for picking out or retrieving the cartridges from the magazine, and returning them thereto, in response to entering of control signals by the patron. In this case a carriage 60 is utilized for that purpose, this carriage being driven and controlled by operating components in the compartment 37. FIGS. 2–5 show the general location and character of the carriage while the details of the operating carriage unit are shown in FIGS. 10–12. The carriage 60 includes a frame 62 made up of front and rear rails 64, 66, which may be square tubular members, extending transversely of the cabinet. These rails are interconnected at the ends by cross pieces 68, and secured to the latter are guide sleeves 70 (FIG. 5) sliding on fixed posts 72 incorporated in the structure. Preferably, a single carriage unit 74 is utilized, although an alternative form having front and rear carriage units is referred to below. The carriage unit 74 is mounted on the frame 62 and has a housing 75 (FIG. 14) with side elements 76. The unit is carried vertically by the frame, and movable transversely thereon along the rails. The carriage is driven vertically by a first or main motor 78 in the compartment 37, through a shaft 92 mounted under the magazine, which has driving connection 94 with the motor. Another shaft 98 is mounted above the magazine, parallel with the first shaft, the shafts being driven in synchronism by endless chains 100. Brackets 102 (FIG. 3) are secured to the cross pieces 68 of the carriage and connected with one run of the respective chains as indicated at 104.

The carriage is counterbalanced for ease in moving it vertically—at each end is a cable 105 secured to the frame and extending upwardly where it runs over pulleys 106, 107 and its downturned upper end has a weight 108 secured thereto. The weight is guided by a pair of near-vertical guide members 109 of T cross section having flanges fitted in grooves in the sides of the weight. The guide elements may be slightly inclined from the vertical to enable the weights to partially rest thereon to prevent rattling. The use of the counterweights enables the use of a drive motor (78) of considerably less power than would be required otherwise.

The carriage unit 74 (FIG. 4) has a sleeve 110 riding on the rail 64, and is driven horizontally on the carriage frame by shafts 112,113, (FIG. 2) at the right and left respectively, having sprockets 115 on which is trained an endless chain 116 the unit being secured to one run of the chain 116 as at 118. The shafts 112, 113 are driven by a second motor 119 (FIG. 5) which for this purpose is mounted on the carriage by means of a suitable bracket 120, the drive from the motor being transmitted through a drive connection 121.

Figure 2:
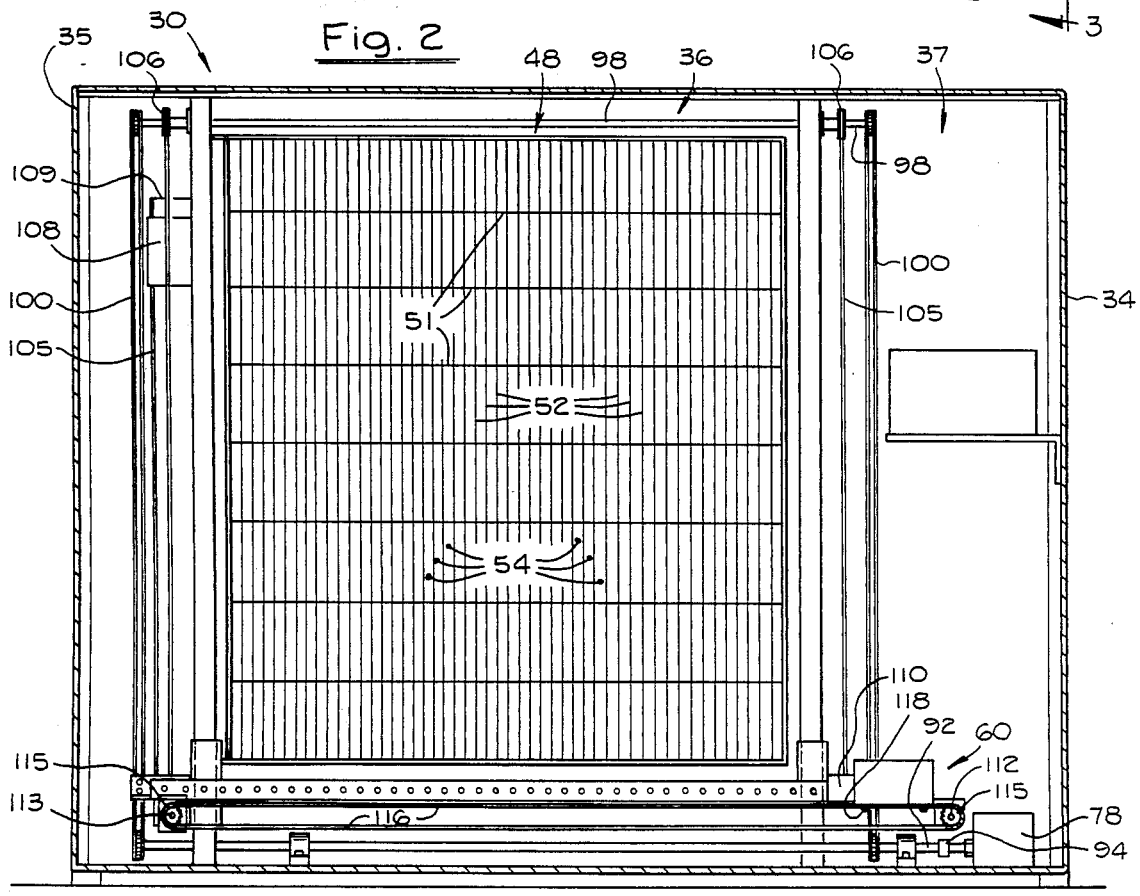
FIG. 2 is a longitudinal vertical sectional view taken at line 2—2 of FIG. 1, showing the interior, and the principal components therein, in a minimum of detail.
Figure 3:
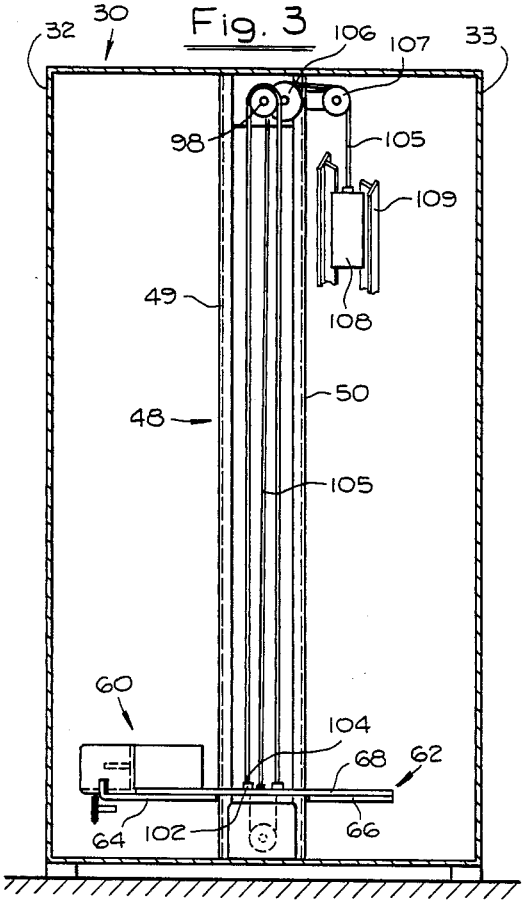
FIG. 3 is a transverse vertical sectional view taken at line 3—3 of FIG. 1.

As will be explained further hereinbelow, the operation of the motors 78, 119, is coordinated so that the carriage unit is moved to position it in perfect alignment with a selected cubicle 54. The shafts 92, 98 and 112, 113, and the sprockets and chains, are accurately interconnected and synchronized so as to eliminate play, and assure the perfect alignment referred to. FIG. 2 shows different positions of the front carriage unit 74 at selected cubicles.

The details of the carriage unit 74 are shown in FIGS. 10–12; a motor 122 is mounted on and carried by the carriage unit, and is operative for actuating a plunger 126 through a rack and pinion 127. This carriage unit includes a slider member 134 connected to the plunger 126, the slider member including gripper fingers 128, and having a normal retracted position, forwardly, clear of the magazine.

The slider member 134, in the construction illustrated, includes a pair of side plates 136 slidably mounted in the side housing element 76, of the carriage unit and having a cross piece 137 secured to the plunger 126. Mounted on the extended ends of the side plates 136 is a pusher plate 138 which engages the cartridge. The gripper fingers 128 are mounted on vertical shafts 139 pivoted in bearings 140 on the side plates. The gripper fingers are biased apart by a tension spring 141 connected between levers 142 on the shafts that extend oppositely from the gripper fingers, and moved toward each other by a solenoid 143 in response to the solenoid being extended, reacting between those levers. The shafts 139 are provided with limit stops **143*a* which engage the side plates 136**, and thereby limit the movement of the gripper fingers outwardly away from each other.

In the vending or retrieving operation, the solenoid 143 is actuated in coordination with the movements of the plunger, under control of the circuitry and computer, as referred to again hereinbelow.

Figure 7:
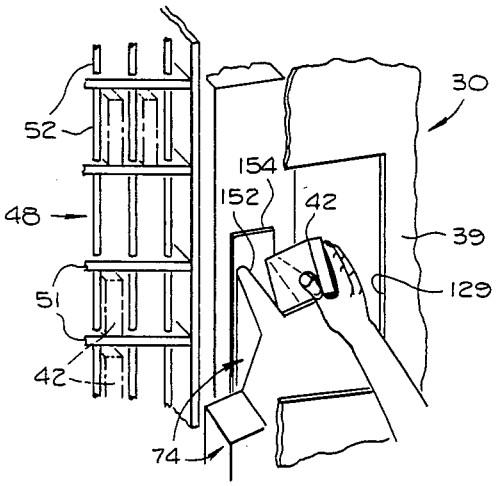
FIG. 7 is a fragmentary perspective view of a portion of the interior of the vending machine.

The specific steps in the operation of carriage unit, in the retrieving operation, are first it is moved to a position in register with a selected cubicle, the slidable member with the fingers spaced apart in non-gripping position is moved rearwardly, toward the magazine, moving the fingers into the cubicle, the fingers are moved toward each other to grip the article therebetween, the slider member is retracted, carrying the article out of the cubicle into the carriage unit, the fingers are drawn apart releasing the article, and the carriage unit, with the article therein, is thereupon returned to home position at the access window 129 (FIGS. 1 and 7).

In the returning phase, that is, in returning the article to the magazine, the movements of the components are essentially the reverse of those in the vending phase; in the returning phase, the article is pushed from the magazine into the cubicle without any gripping action of the gripper fingers 128, and the plunger is then withdrawn, leaving the article in the cubicle.

Figure 13:
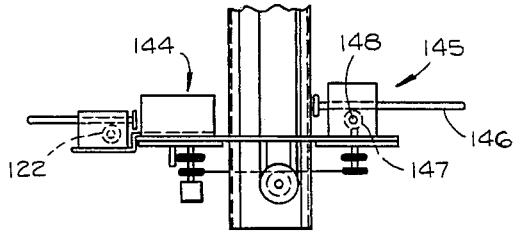
FIG. 13 is an end view, oriented according to FIG. 3, showing a portion of modified form of carriage.

FIG. 13 shows a modified form of carriage including two carriage units 144, 145, utilized in the operation; briefly stated, the front carriage unit 144 performs inserting and retrieving functions in cooperation with the rear unit 145. In the inserting function, upon actuation of, the motor 122, the plunger is moved rearwardly and it pushes the cartridge from the carriage unit into the cubicle at which the unit is positioned and upon that act being completed, the plunger is retracted.

The rear carriage unit 145 is utilized in the retrieving function, and includes a plunger 146 actuated by a motor 147, carried by the unit, by means of a rack and pinion 148. The plunger assumes a normal retracted position in which it is clear of the magazine, and upon actuation thereof, it is advanced and moved into the cubicle at which the unit is positioned, and pushes the cartridge that is in that cubicle, from the cubicle into the front unit 144. After the article is thus ejected from the cubicle, the plunger is moved again to retracted position. The control of the motor 122 is referred to again hereinbelow.

Referring again to the single carriage unit 74 (FIGS. 10–12), this unit is utilized for holding a cartridge, in the home position of the unit (FIGS. 1, 4, and 7), in such position that the cartridge can be lifted out by the patron through the access window or opening 129, and again re-inserted through that window.

In the unit 74 the vertical side elements 76 (FIG. 14) are spaced apart a relatively small distance at their rear or inner ends **76*a*, adjacent to the magazine, and diverge forwardly, i.e., toward the front of the machine, defining a space 150 therebetween for receiving and holding the cartridge. The space 150** is open at the rear, enabling the cartridge to be moved therethrough. In the movements of the carriage, the rear open end moves in and through a plane parallel with and closely adjacent to the plane of the front side of the magazine.

In a typical vending or returning operation, the patron initiates the operation by performing certain steps, including identifying certain buttons or inserting an ID card; in a vending operation, he identifies the article (cartridge) and produces a vending signal, and in a returning operation, he inserts the cartridge and produces a returning signal. Thereafter, the computer works through a corresponding sequence and the vending machine similarly performs a corresponding operation, without further attention from the patron. As a consequence, the computer does not rely on any other signals picked up in its normal operation in order to complete its operation such as identifying or locating a cubicle. The signals entered by the patron predetermine the complete operation, that is, the operation proceeds according to pre-entered signals. Any signals encountered in its operation are treated according to the pre-entered signals.

In the typical vending operation, after the patron enters the initiating steps, the carriage 60 moves for positioning the carriage unit 74 at that cubicle having the selected cartridge. Then the cartridge is withdrawn from the cubicle in the manner stated, and the carriage is moved to place the unit 74 in the home position (FIG. 7), i.e., adjacent the window 129, as noted, and the patron reaches in and lifts out the cartridge thus selected. The unit 74 includes a guide element 151 which may be a sheet of transparent material, positioned horizontally, and having a slot 152 for receiving the cartridge and holding it upright, in a position referred to for convenience as a returning position. The carriage 60, and the unit 74 thereon, may be driven by any of the various means, such as the motors 78, 119, 122 utilized herein. In this case, those motors are of stepping type, i.e., advancing a predetermined step in response to an electrical impulse. In the vending operation, these impulses are controlled by the computer, as referred to hereinbelow, the computer being programmed to effect a predetermined number of pulses for driving each motor the desired extent for moving the corresponding component to its proper position, in both the selecting-/vending phase and the returning phase.

Various indicia and sensing elements are utilized in the selecting/vending phase and the returning phase of the operation. These elements come into play in various ways, such, for example, as detecting the presence of a cartridge when such is returned by a patron; to determine whether it is an authorized cartridge; whether the cartridge is placed properly in the carriage by the patron; identifying the particular cartridge for returning it to its assigned cubicle; and other various steps. As noted above, the cartridge is provided with sensing elements 44, 46, (FIG. 6), and these elements are shown again in FIGS. 14–16. The lower area 44*a* of the element 44 may be a simple reflector, while the upper one, 44*b*, may be an identification element such as a zebra stripe pattern. Any of various kinds of identification sensing elements may be used.

Figure 15:
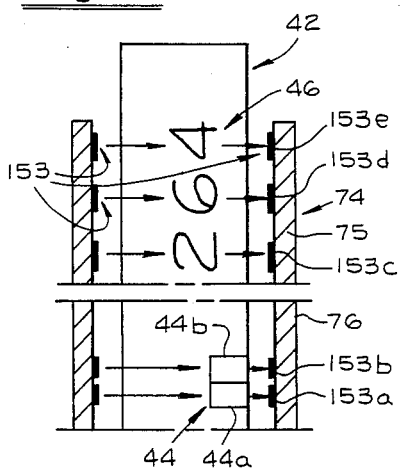
FIG. 15 is a fragmentary view oriented according to line 15—15 of FIG. 14 showing a plurality of sensing elements.
Figure 16:
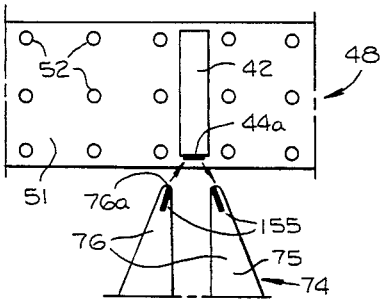
FIG. 16 is a horizontal view similar to FIG. 8, but with the carriage at a different position.

In the present arrangement, the sensing element 46 (FIG. 6) includes visually readable numerals, such as indicated in FIGS. 6 and 15, for visually identifying the cartridge by the patron and others, and the individual digits thereof may be utilized as sensing elements. For use in conjunction with these elements 44, 46, a plurality of pairs of cooperating sensors 153 are provided and placed in a suitable location such as in vertically spaced positions on the front edges of the side elements 76 of the housing 75 of the carriage unit 74, those of each pair being aligned transversely, as shown best in FIG. 15. The pairs are individually identified with the same reference numeral with the subscripts a, b, c, d, and e respectively.

An advantageous feature of the apparatus is that an article (the cartridge 42) is accommodated and utilized with only a very slight modification from its original condition, i.e., as produced by the original manufacturer and before adapted to this vending machine. The cartridge shown in FIG. 6 is structurally unchanged. The sensing element 44 may be a simple piece of foil, applied to the cartridge case, and the cartridge may have, in its original manufacture, a structured contour in which the foil may be placed. Similarly, the sensing element 46 may be only a piece of foil applied to the cartridge case.

In the ordinary use of the vending machine, the vending and returning operations are separate and distinct, and there is no necessary connection between them and either may be performed without the other being performed. However, many times a patron will return a cartridge before selecting a new one, perhaps for convenience, and perhaps to establish credit by returning a cartridge for a new one. In the description herein, the two operations are treated separately, and thus independently of the order of their occurrence.

Figure 20:
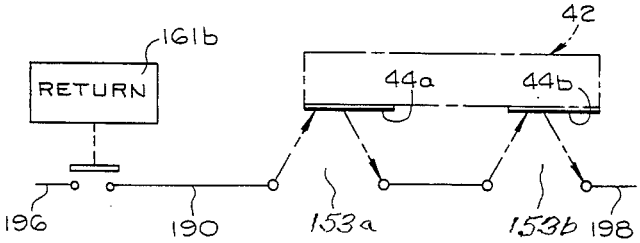
FIG. 20 is a fragment of an electrical circuit representing a step in the returning phase.
Figure 22:
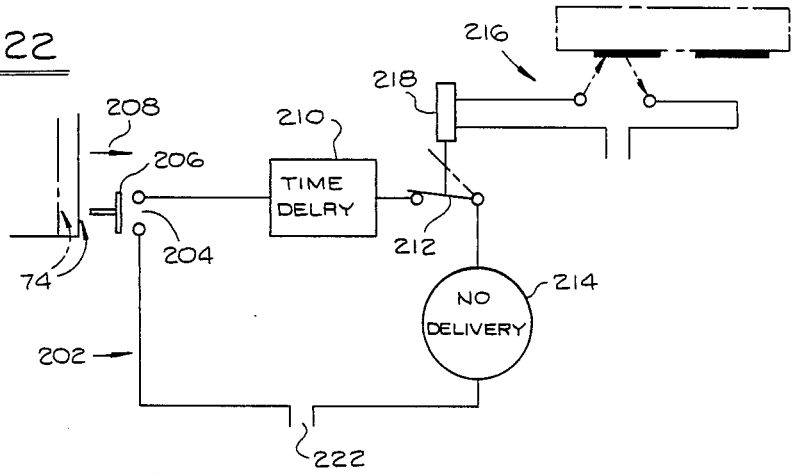
FIG. 22 is a fragment of electrical circuit for determining whether an article has been delivered or not, in response to a selecting step.

In the first step in a control and operating phase, as for example when the patron returns a cartridge, he reaches through the window 129 and places it in the carriage unit 74, and the sensors 153*a* (FIGS. 14 and 15) coact with the sensing element 44*a* which as indicated above may be simple reflector element. This step determines the presence of the cartridge and is used in the control circuit as represented in FIGS. 20, 22 and referred to hereinbelow.

It is of course necessary that the vending machine detect whether the cartridge to be returned is authentic, i.e., one that was previously vended from that machine, or another authorized machine, and for this purpose the sensing element 44*b* is utilized, being sensed by the pair of sensors 153*b* (FIG. 15) and in this step attention is again directed to the control circuit of FIG. 22 as referred to below.

For identifying each individual cartridge, the numeral digits in the sensing element 46 are utilized. In the example shown, the cartridge is identified by the number "264" and these number digits may be of desired shape, as utilized for sensing purposes, in a known manner. When a cartridge so identified is in position in the carriage unit 74, (FIG. 15) the sensors 153*c* are in line with the first digit "2"; the next pair of sensors 153*d* are in line with the second digit "6"; and the third pair of sensors 153*e* are in line with the numeral "4". This arrangement of the various sensing elements therefore energizes the corresponding circuit portions, for enabling the operating steps to take place, and specifically for moving the carriage to the cubicle in the magazine to which that article is assigned.

Figure 8:
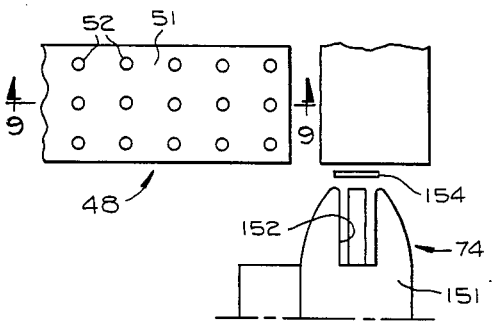
FIG. 8 is a fragmentary horizontal view of the center portion of FIG. 7.
Figure 9:
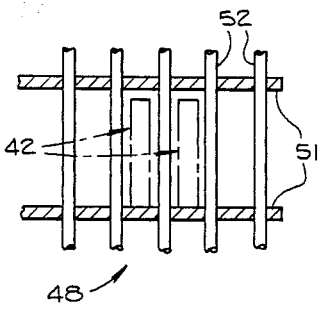
FIG. 9 is a detail view of a portion of the magazine, taken at line 9—9 of FIG. 8.

When the carriage unit 74 is in its home position (FIG. 8), it is displaced laterally beyond the magazine, to the right, and faces a stop plate 154 preventing accidental displacement of the cartridge in that direction from the carriage.

The carriage unit 74 includes additional sensors 155 (FIG. 16) on the inner ends 76*a* of the side elements 76, cooperating with the sensing element 44*a*, when the cartridge is in a cubicle and the carriage unit is positioned at that cubicle. These sensors 155, being close to the magazine, and therefore close to the cartridge in that cubicle, are thus in position to accurately coact with the sensing element 44*a* on the cartridge. This feature is utilized in assuring that the cartridge has been inserted in its own cubicle, and consequently energizing the circuit for then returning the carriage to its home position.

The foregoing sensing elements on the cartridges and sensors on the carriage, and the control steps in connection therewith, are utilized in both the carriage unit 74 of FIGS. 10–12, and 144 of FIG. 13.

The foregoing description has to do with the physical construction of the machine, and its mechanical operation, and a portion of the electrical operation, in a general sense, while the following covers the specific and detail control functions, and particularly the electronic controls involving especially the computer, identified below.

Reference is again made to FIG. 1 and particularly the controls 40 identified above as a group. These controls include a computer 156 of suitable and known kind, such for example as the Apple Model IIe, although it will be understood that other kinds of computers may be used, various ones being capable of being programmed for performing the control functions mentioned above and referred to hereinbelow. The computer 156 may be a self contained unit, or it may have various sub-units or components at various locations in the structure according to convenience. It has a screen 158 exposed to the exterior, for observation by the patron, and others. The computer includes a set of pushbuttons or keys 160 for manipulation by the patron, and preferably also, a set of pushbuttons or keys 162 located inside the cabinet and inaccessible to the patron, for use by a service man. The control panel 39 includes various other features and items, such as a slot 164 for receiving a value piece 166 which may be a money coin, a token, etc. If desired, a money control unit utilizing paper money may be used, having associated therewith a slot 168 for receiving paper money 170. Also the control panel includes a slot 172 for receiving an identification (ID) card 174.

As disclosed in our patent identified above, each patron is assigned an ID code number, and to operate the machine, he enters that number therein. This may be done by depressing the corresponding pushbuttons or keys 160 or by inserting his ID card 174 that is issued to him, bearing his ID number. Each ID card has elements 176 thereon, representing the ID number of the patron and other items, and which perform control functions in the machine, upon insertion of the card thereinto.

Also, as disclosed in that patent, the operation of the apparatus involves either the insertion of a value piece (166) or establishment of credit. Such credit, prearranged between the patron and the operator of the apparatus, is effectively incorporated in the identification of the patron, and the electrical circuit is complete in so far as that feature is concerned, and in the absence of such credit, a value piece (166) must be inserted to complete that portion of the circuit.

Figure 17:
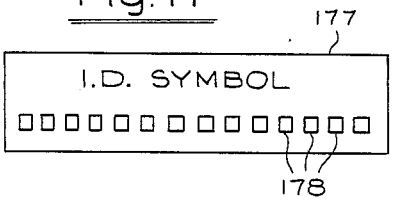
FIG. 17 is a symbol representing the identification of a patron.

FIG. 17 shows a symbol 177 representing broadly the identification feature, whether the identification is entered by depressing the pushbuttons 160, or inserting the ID card. The symbol includes a plurality of elements 178 which may represent either the pushbuttons 160, or the elements 176, and this symbol 177 is shown in various ones of the circuit fragments in the drawings where it indicates the entrance of the identification into the machine.

The control panel includes other pushbuttons or keys, indicated generally at 161 for specific operations, such as "select," "return," etc., the individual ones of which are identified with the same reference numeral with the postscripts a, b, etc.

Figure 18:
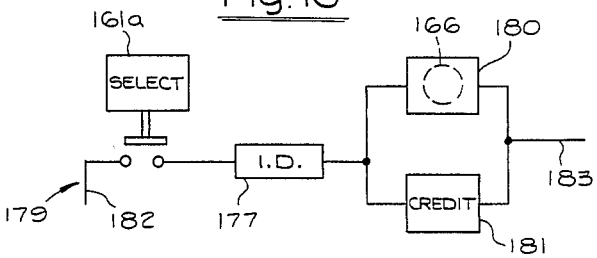
FIG. 18 is a fragment of an electrical circuit representing a step in the selecting/vending phase.

In the operation of the vending machine, a first step is assumed as represented in FIG. 18. This figure includes an electrical circuit element 179 and the "select" pushbutton 161*a*. In series with this select pushbutton is the ID symbol 177, as well as an element 180 in which the value piece 166 is inserted, and an element 181 representing the presence of credit for the particular patron. These latter two elements 180, 181, are in parallel, and the two together in series with the other elements. Following insertion of the ID information, and either the value piece inserted or credit established, then depression of the pushbutton 161*a* results in completion of the circuit element 179 between the terminal points 182 and 183, which then becomes operable for energizing another portion of the circuit.

Figure 19:
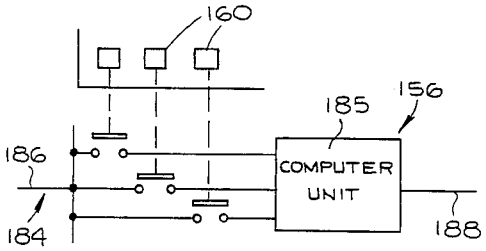
FIG. 19 is a fragment of an electrical circuit representing another step in the selecting/vending phase.

FIG. 19 includes a circuit element 184 energized by various ones of the pushbuttons 160, actuated for selecting a particular cartridge. This kind of circuitry is known, and upon depression of the desired pushbuttons, the circuit element 184 is energized, through a control unit 185 forming a portion of the computer 156. In the example given above for the cartridge shown in FIG. 6, the pushbuttons numbered "2", "6", and "4" are depressed. Upon the selecting steps being performed, signals are transmitted to the controls of the motors 78 and 119 which are thereby advanced corresponding numbers of steps, and they move the carriage to the corresponding cubicle of the magazine. It may be connected at one terminal 186 to the terminal 183 of FIG. 18, and at an opposite terminal 188 with another circuit element.

Upon the foregoing initial selection steps being made by the patron, and the carriage is positioned at the cubicle mentioned, the following detail steps are performed under the control of the computer 156: the motor 122 (FIG. 10) is activated, advancing the plunger 126 which moves the slider member 134 which extends into the cubicle with the gripper fingers 128 spread; then the gripper fingers are moved toward each other and they grip the cartridge; following that, the motor is reversed, which retracts the plunger and carries the cartridge from the cubicle into the carriage, and spreads the gripper fingers and releases the cartridge. Then the motors 78, 119 are driven to return the carriage to its home position (FIG. 2), enabling the patron to lift the cartridge out through the access window 129.

In the continuing operation of the apparatus, the sequence of steps is controlled, in large part, by the completion of one step initiating a following step. For example, upon the carriage reaching the selected cubicle, that physical positioning serves to initiate energization of the motor 122; the plunger 126 upon reaching its fully advanced position, initiating the gripping action of the fingers and the reverse driving of the motor, and upon reaching its fully retracted position, initiating driving of the motors 78, 119, to return the carriage to its home position. This sequential step control operation, and other types of control operation are of known kind, and performed by the computer 156. Therefore it is believed not necessary to describe such sequence in detail, but the description hereinbelow includes a complete delineation of those steps, and illustration thereof in FIG. 26.

In the returning phase, the operating steps are similar to those in the vending phase, as indicated above, but in opposite timing and direction. In the returning phase, the patron returns the cartridge through the window 129 to the carriage unit 74 (FIG. 7) as noted, and desirably places it in properly oriented position, or returning position. This positioning of the item involves the sensing element 44*a* (FIG. 6) and the specific location of that sensing element on the cartridge. As will be observed from FIG. 6, the sensing element is below the midpoint line 47 and when the cartridge is put in proper position, oriented as in FIG. 7, the sensing element 44*a* is at a lower position and the sensors 153*a* (FIG. 15) are aligned therewith. If the cartridge would for example be inverted end for end, the sensing element 44*a* would be near the top and out of alignment with the sensors 153*a*, preventing further functioning of the machine.

As noted above, it is obviously necessary that the cartridge that is returned be an authorized one, and for this purpose the sensing element 44*b* is utilized. The identification as to ownership is contained in this element, and when the cartridge is properly placed in the carriage (FIG. 7) the sensors 153*b* (FIG. 15) are in alignment with the sensing element 44*b*, and the corresponding portion of the electrical circuit is thereby energized.

FIG. 20 includes a circuit element 190 representing the functioning of the sensing elements 44*a* and 44*b*. This circuit includes the "return" pushbutton 161*b*, the sensors 153*a*, and the sensors 153*b*. When the cartridge is in proper position in the carriage the sensing elements enable closure of the circuit through the sensors, and then upon depression of the "return" pushbutton 161b, the circuit element 190 is completed. This circuit element 190 includes terminal elements 196, 198 for connection with corresponding terminal elements in other parts of the circuitry.

Figure 4:
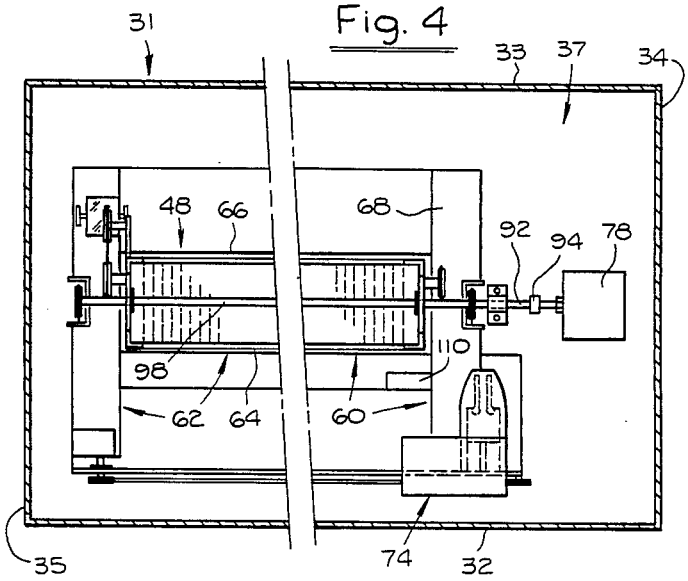
FIG. 4 is a horizontal sectional view taken at line 4—4 of FIG. 1.
Figure 5:
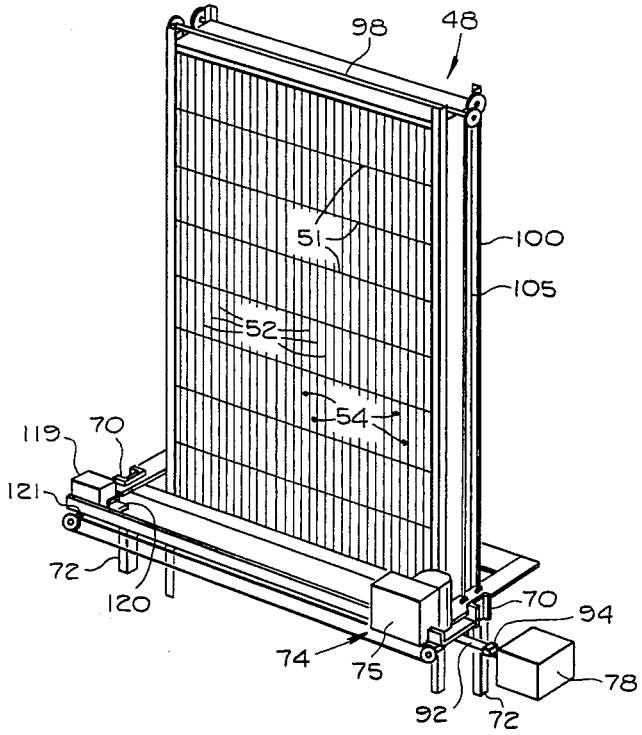
FIG. 5 is a perspective view of the magazine for holding the articles to be vended, constituting one of the main components in the interior of the vending machine.

In conjunction with sensing the elements 44a, 44b, as just referred to, the sensing element 46 comes into play, and the digits thereon are sensed, as indicated in FIGS. 4, 15, and described above. In this condition of the various elements, depression of the pushbutton 161b (FIG. 20) initiates return of the cartridge, if the other portions of the circuitry are properly conditioned.

Figure 21:
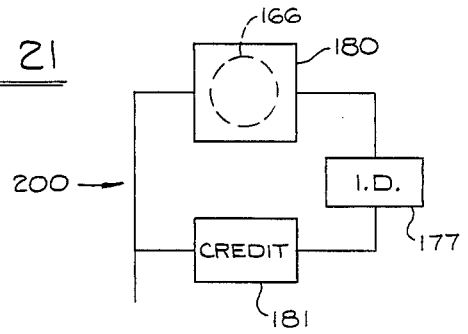
FIG. 21 is a fragment of an electrical circuit representing an operating step in which a value piece is utilized.

Provision is made to give credit to the patron, in response to deposit of money, whether or not a vending operation is performed, and whether or not a returning operation is performed. On this feature, attention is directed to FIG. 21, where a circuit element 200 includes in series, the element 180 (see also FIG. 18), the ID symbol 177, and a credit unit 181. Upon insertion of the value piece 166 in the element 180, and entry of the ID number which is incorporated in the symbol 177, the credit for the value of that money is entered in the credit unit 18, because of the completed circuit element 200, regardless of the return or vending of a cartridge. It will be noted that the returning and vending element are parallel with the circuit unit 181.

In the returning phase, in the case of the single carriage unit 74 (FIGS. 10–12), the specific steps and detail movements that are performed, include—placing the cartridge in the carriage; sensing of the sensing element 44a which determines the presence of an article to be returned; sensing of the sensing element 44b to determine whether the article is authorized; sensing of the digits "264" in the sensing means 46; operating the motors 78, 119, in unison or sequentially, and moving the carriage to the cubicle to which the cartridge is assigned; actuation of the plunger 126 which moves the cartridge into the cubicle; retraction of the plunger; and again operating the motors 78, 119 and moving the carriage to home position.

In the vending phase, the specific steps and detail movements that are performed include—depressing the selecting pushbuttons; the carriage unit 74 moves to the cubicle of the selected cartridge; sensing of the sensing element 44a which determines the presence of the cartridge in that cubicle; operation of the motor 122; extending the slider member 134 with the gripping fingers spread, into the cubicle; moving the gripping fingers into gripping position; reversing the motor; operating the motors 78, 119 in reverse direction.

In the case of the two carriage units 144, 145, the specific steps are similar to those of the carriage 60 in moving the carriage unit to and from the cubicle, but when the carriage is at the cubicle, the steps and movements include—in the returning phase, only those referred to above in connection with the single unit case are performed; in the vending phase, the steps include advancing the slider member 134, with the gripper fingers 135 in spread position until the fingers enter the cubicle; actuating the solenoid 143, causing the fingers to grip the cartridge; retracting the slider member to withdraw the cartridge from the cubicle into the carriage; de-energizing the solenoid and enabling the tension spring 141 to spread the fingers. Then the carriage is returned to home position.

FIG. 22 represents a step in the operation, concerning the delivery of a cartridge to the patron. This figure shows a circuit element 202 including a pair of contacts 204 closed by a contactor 206. This figure also shows the carriage unit 74 approaching its home position as indicated by the arrow 208. Upon tho carriage unit reaching its home position, It engages the contactor 206 and closes the circuit element. The circuit element includes a time delay device 210, normally closed and operable for breaking the circuit following the delay period for which it is set. Also included in the circuit element is a normally closed switch 212 and a signal light 214 which may be a red light, for example, with the inscription "No Delivery."

The switch 212 is actuated by a sub-circuit element or relay 216 including a solenoid 218 operable when energized for opening the switch. Included in the sub-circuit 216 are the sensors 153a positioned for sensing the sensing element 44a, on the cartridge 42, when the cartridge is in the carriage and the carriage is in home position.

The operation of the arrangement of FIG. 22 is that, with the switch 212 in closed position, and the carriage 74 reaching home position, the carriage closes the contacts 206 and completes circuit through the time delay 210 and the signal light 214; this condition exists in the event there is no cartridge in the carriage, and the switch 212 therefore remains closed. Thus the signal light is lighted, and the patron observes that such is the case, and takes appropriate steps, such as notifying the operator. In this case however it is desired that the signal light not remain lighted indefinitely, and the interposition of the time delay device opens the circuit at the end of the time period set.

However, when a cartridge is present in the carriage when the carriage reaches home position, the circuit element 202 and sub circuit element 216 are completed through the contacts 204 and the sensing element 44a; this energizes the solenoid 218, opening the switch 212 and precludes lighting of the signal light. The circuit element includes terminals 222 for connection in other portions of the main circuit.

Figure 23:
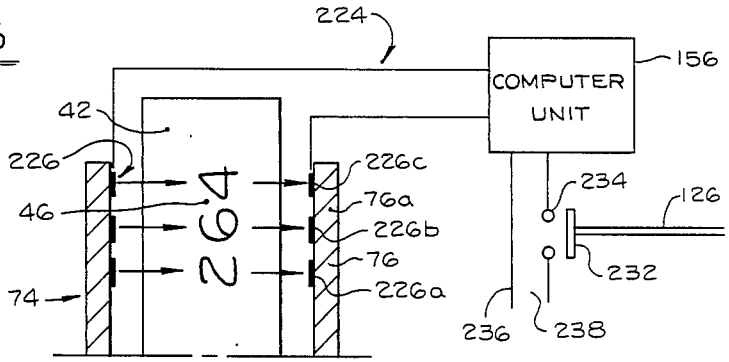
FIG. 23 is a fragment of electrical circuit utilized in determing that an article has actually been replaced in a cubicle in the, magazine.

The apparatus also includes means for assuring that the cartridge being returned is actually returned to the cubicle to which it is assigned. This arrangement is represented in FIG. 23, which includes a circuit element 224 in association with the carriage unit 74 and the cartridge 42 being returned. This figure shows portions 76a of the side elements 76 of the carriage unit, these portions being the rear portions thereof adjacent the magazine. As noted above, each cartridge is assigned to a particular cubicle in the magazine, the cubicle itself perhaps being numbered, and the cartridge is to be returned to the cubicle to which it is assigned. In the normal returning of the cartridge to the cubicle, the carriage is to be moved to the assigned cubicle in accordance with the signals entered into the computer when the cartridge is placed in the carriage by the patron, and in order to positively determine that that cartridge has been returned to the corresponding cubicle, the operation represented in FIG. 23 is resorted to. The side elements of the carriage unit adjacent their rear edge are provided with vertically spaced pairs of sensors 226, each pair being identified with the same reference numeral with the postscripts a, b, c, those of each pair being transversely aligned, and so aligned with corresponding digits of the sensing element "264". Signals are transmitted through the circuit element to the computer; the computer and the circuit element are thus conditioned for further actuation by a succeeding step in the operation. This succeeding step, in the present instance, is accomplished by the return of the plunger 126 in the carriage unit 74 (FIGS. 12 and 23). The plunger carries a contactor 232 operable upon such return for closing contacts 234 in a sub-circuit element 236, completing circuit through the computer 156 and thus determining the following operating step, namely, if the cartridge is returned to the proper cubicle, the next operating step is performed, returning the carriage to home position. The sub-circuit element 236 is provided with terminal elements 238 for connection with other circuitry.

Figure 24:
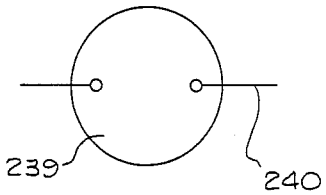
FIG. 24 is a diagrammatic illustration of a detector and electrical circuit for detecting the presence of a patron.

FIG. 24 shows a detector 239 in a circuit element 240. This is a flesh detector of known kind, and detects the presence of a patron in front of the machine in position for operating it. When he is in that position, the device energizes the operating circuit, but when he leaves it, the device de-energizes the whole circuit.

Figure 25:
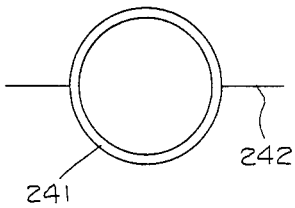
FIG. 25 is a diagrammatic illustration of a control button and electrical circuit for use by the patron.

FIG. 25 shows a pushbutton 241 in a circuit element 242, and serves the same general purpose as the detector 239, i.e., the patron, in position for making a selection, holds in the pushbutton, and this energizes the operating circuit, and when he releases it, the whole circuit is de-energized. The devices of FIGS. 24 and 25 may be used alternatively.

In the use of either of the devices of FIGS. 24 or 25, the overall effect is that, if a patron leaves the machine before the indicated operating steps are completed, the whole circuit, the machine, revert to their initial condition, and are operable to respond completely to a new selecting procedure.

FIG. 26 diagrammatically shows the computer 156 and the functioning steps controlled thereby. All of the functioning steps are presented in this figure, and as pointed out above, the returning phase and selecting-/vending phase are independently operable. For convenience the steps in the returning phase are set out first in the left hand column, followed by those of the selection/vending phase, in the right hand column.

A conventional source of current is indicated at 244 and the computer is programmed in a known way to control the various steps referred to above. In the diagram of FIG. 26 these steps are shown in a general way as being associated with the computer itself, the diagram indicating that the pulses for actuating and controlling them are derived from the computer, and transmitted through circuit elements 246, 248. Since the computer itself is of known kind, and it can be programmed in virtually endless ways, it is believed unnecessary to go into any detail in this step of the operation.

A set of steps take place in the control of the computer, similar to those set out in FIG. 26, in connection with the two-unit carriage of FIG. 13, but it is believed not necessary to set them out in detail.

As noted, the construction of the machine, and the arrangement of the components thereof, are particularly adapted for full control and operation by the computer throughout a full pattern of operation, or program. The computer is adapted for programming of virtually endless information for control and operation of the machine according to the nature of the machine, and according to a pattern of operation initiated by a patron.

One of the phases of operation has to do with the operation of the drive motors. Instead of using stepping motors, the computer may be arranged for moving an arm, both in angular, and vertical and horizontal directions for retrieving and returning the cartridges. These operational steps may be entered into the computer and carried out according to the information corresponding to the identification of each individual cartridge.

Another phase of the operation has to do with the identification of the cartridges. Any of various kinds of identification may be utilized. For example a patron's own record, in the computer, may include the identification of a cartridge according to its location in the magazine, and keyed to the identification of the patron, according to his own identification indicia, either by depression of pushbuttons or insertion of his ID card, and when a cartridge is returned by a patron, the information previously entered into the computer according to this program is called upon to return the cartridge to its proper cubicle. The identification indicia on the cartridge need not be that referred to above, namely, numerical digits, but can be any of a wide variety of indicia. A simple reflecting element may suffice.

Another operational feature incorporated in the machine is that a record is kept of the cartridge that is withdrawn 25 by a patron, for a period of time,—if a cartridge that is withdrawn, is later found to be damaged, or otherwise not in perfect condition, tho last patron before the present patron can be identified, and based on that information, the owner can determine whether the damage was done by the previous patron or the present patron. After a current patron returns a cartridge, and that fact is entered into the computer, the item is deleted from the record of the previous patron, but the record of the present patron continues in effect, so that in the case of a later patron coming into a similar set of facts, any question can be resolved in the same manner as in the previous instance. A record thus is kept of the last patron through the time when the following patron withdraws and returns a cartridge.

Another operational item of information entered into the programming of the computer is that when a patron makes a selection, and correspondingly makes payment therefor, either by way of inserting a value piece, or being debited in his credit account by the fact of selection, and it is found that the cubicle to which the selected cartridge is assigned, is empty, and no cartridge can be delivered, then the patron will be credited with the value corresponding to that selection. Accordingly the situation will not occur wherein a patron is debited with a certain money value without being credited therefor in the absence of a cartridge that is selected.

Still another and important feature is a security aspect, and this has to do with the attempt by a person to obtain control or effect a vending operation by utilizing a random number. It is preferred that a computer component be utilized that has a potential range of identifying numbers far beyond those actually used. For example, a particular vending machine or station may have the identification entered thereinto of 3,000 or 4,000 patrons, but it has a capacity of many times of that number, such as for example 100,000. If a person, not an identified patron, thus enters a random number, the chances are great that it would be a number not assigned to an identified patron. If such a number is entered once, for example, or even twice, no consequence will be experienced, but if he does so a third time, an alarm will be effected, preferably a sound alarm. The person himself will know why the alarm went off, but bystanders may not, and if that event happens once, a person would likely express an excuse that may sound plausible, and not be cause for concern to observers. However if the same person causes the alarm to be sounded a second time, or again a third time, he will obviously be suspect by the observer, and particularly by the owner, and will accordingly would be discouraged from returning to those premises.

The particular means or components in the computer for effecting operational steps referred to may be of different kinds, such for example as digital encoders or analog potentiometers. A digital encoder arrangement may include for example a sensing component at each location desired, such as at each cubicle, and as the carriage unit, or equivalent component, moves by that location, a signal is produced to identify that location as the one desired, and effect a corresponding operation in the computer. In the case of an analog potentiometer arrangement, the potentiometer is advanced an extent corresponding to the movement of the member being controlled, in an advancing direction, and when it reaches the intended extent of movement, the computer terminates that movement. That advancing movement of the member produces a continuous or analog condition in the computer, and as the member is returned, the condition set up in the computer is cancelled or nullified. Both of these kinds of operation are known, and may be applied to the present case for performing the operational steps mentioned, according to the character of the present machine.

We claim:

1. Apparatus for vending cartridges to a patron and accepting the cartridges in return from the patron in connection with which the patrons are assigned identification numbers individually identifying them, wherein, the apparatus includes first means including first sensing elements capable of selectively representing the identification numbers of the patrons, the cartridges bearing (a) second sensing elements individually identifying the cartridges, (b) third sensing elements indicating the presence of the cartridges in the apparatus, (c) fourth sensing elements indicating that the cartridges are authorized to be accepted in the apparatus, a magazine having a plurality of cubicles adapted to support the respective individual cartridges therein, and being stationary and static, and of which all parts are fixed, and adapted to have cartridges placed therein and removed therefrom by means independent of the magazine, the cubicles in the magazine being individually identified by their location in the magazine, a carriage movable between a home position in which it is accessible to a patron, and a second position relative to each of the cubicles selectively, for movement of a cartridge between the carriage and respective cubicle, and including operating means for so moving the cartridge, driving means for moving the carriage between its said positions, control means, said first means being operable in response to manipulation by a patron for entering first signals into the apparatus and thereby conditioning said first sensing elements for representing the patron's identification number, the apparatus also includes second means, third means, and fourth means, the second means being operable in response to manipulation by a patron for entering second signals into the apparatus representing the elements identifying the cartridges, the third means being operable in response to a manipulation constituted by insertion of an authorized cartridge into the apparatus for entering third signals into the apparatus representing the presence of an authorized cartridge in the apparatus, the fourth means being operable in response to manipulation by a patron for entering fourth signals into the apparatus representing movement of the carriage between its said positions, said manipulations constituting initial manipulations predetermining a pattern of operation of movements as set out hereinbelow, the control means including first sensors, second sensors, third sensors, and fourth sensors, respectively operably associated with the first signals, second signals, third signals, and fourth signals, the second and third sensors being operable for respectively sensing the second and third sensing elements and thereby conditioning the control means, the control means when so conditioned, being operable, in response to the fourth sensors sensing the fourth sensing elements, for controlling the driving means and operating means, for performing said pattern of operation of movements which are (a) moving the carriage from its home position to its second position, (b) transferring a cartridge between the carriage and a respective cubicle, (c) moving the carriage from its second position to its home position, the control means, when so conditioned, and the fourth sensors, constituting means sufficient in themselves for producing said pattern of operation of movements set out above and producing those movements, in response to said initial manipulations and consequent sensing function of operable interaction between the fourth sensing elements and the fourth sensors.

2. Apparatus according to claim 1 wherein, the carriage and cartridge are so interrelated that the cartridge has a return position in the carriage, in which said sensing elements on the cartridge are in a sensing position, and said sensors in the control means, associated with the sensing elements on the cartridges, being co-operable with those respective sensing elements when the cartridge is in its said return position and the sensing elements and sensors being thereby capable of enabling the control means for controlling the driving means, and when there is no cartridge in said return position, the control means is disabled.

3. Apparatus according to claim 1 wherein, the operations, manipulations, and movements constitute a vending operation, the apparatus includes fifth means for entering fifth signals representing the value of a cartridge, said second signals are constituted by signals independent of and separate from the cartridges and resulting from manipulations by a patron, said transferring of the cartridge between the carriage and the cubicle is constituted by so transferring it from the cubicle to the carriage, and the fifth signals are necessary for enabling the control means.

4. Apparatus according to claim 1 wherein, the manipulations, operations and movements constitute a returning operation, wherein, said second signals are constituted by signals produced by a cartridge in position in the apparatus, and said transferring of the cartridge between the carriage and the cubicle is constituted by so transferring it from the carriage to the cubicle.

* * * * *